US010224196B2

(12) United States Patent
Giles et al.

(10) Patent No.: US 10,224,196 B2
(45) Date of Patent: Mar. 5, 2019

(54) ION TRAP WITH SPATIALLY EXTENDED ION TRAPPING REGION

(71) Applicant: Micromass UK Limited, Wilmslow (GB)

(72) Inventors: Kevin Giles, Stockport (GB); Martin Raymond Green, Bowdon (GB); Daniel James Kenny, Knutsford (GB); David J. Langridge, Macclesfield (GB); Jason Lee Wildgoose, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/243,200

(22) Filed: Aug. 22, 2016

(65) Prior Publication Data

US 2017/0140916 A1 May 18, 2017

Related U.S. Application Data

(63) Continuation of application No. 14/240,586, filed as application No. PCT/GB2012/052054 on Aug. 22, 2012, now Pat. No. 9,425,035.

(60) Provisional application No. 61/528,956, filed on Aug. 30, 2011.

(30) Foreign Application Priority Data

Aug. 25, 2011 (GB) ..... 1114734.5

(51) Int. Cl.

| | |
|---|---|
| ***H01J 49/42*** | (2006.01) |
| ***H01J 49/00*** | (2006.01) |
| ***H01J 49/40*** | (2006.01) |
| ***H01J 49/06*** | (2006.01) |

(52) U.S. Cl.

CPC ..... *H01J 49/4285* (2013.01); *H01J 49/0031* (2013.01); *H01J 49/062* (2013.01); *H01J 49/063* (2013.01); *H01J 49/40* (2013.01); *H01J 49/422* (2013.01)

(58) Field of Classification Search

USPC ..... 250/282

See application file for complete search history.

(56) References Cited

U.S. PATENT DOCUMENTS

| | | | | |
|---|---|---|---|---|
| 5,783,824 | A | 7/1998 | Baba et al. | |
| 6,111,250 | A * | 8/2000 | Thomson | H01J 49/4225 250/281 |
| 6,483,109 | B1 | 11/2002 | Reinhold et al. | |
| 6,838,666 | B2 | 1/2005 | Ouyang et al. | |
| 6,956,205 | B2 | 10/2005 | Park | |
| 7,034,293 | B2 | 4/2006 | Wells | |
| 7,141,789 | B2 | 11/2006 | Douglas et al. | |

(Continued)

FOREIGN PATENT DOCUMENTS

| | | |
|---|---|---|
| GB | 2390935 | 1/2004 |
| WO | 2005/067000 | 7/2005 |

*Primary Examiner* — Phillip A Johnston

(57) ABSTRACT

A mass or mass to charge ratio selective ion trap is disclosed which directs ions into a small ejection region. A RF voltage acts to confine ions in a first (y) direction within the ion trap. A DC or RF voltage acts to confine ions in a second (x) direction. A quadratic DC potential well acts to confine ions in a third (z) direction within the ion trap. The profile of the quadratic DC potential well progressively varies along the second (x) direction.

17 Claims, 10 Drawing Sheets

(56) References Cited

U.S. PATENT DOCUMENTS

| | | | | |
|---|---|---|---|---|
| 7,157,698 | B2 | 1/2007 | Makarov et al. | |
| 7,196,324 | B2 | 3/2007 | Verentchikov et al. | |
| 7,405,401 | B2 | 7/2008 | Hoyes | |
| 7,557,343 | B2 * | 7/2009 | Hansen | H01J 49/4225 250/281 |
| 7,592,589 | B2 | 9/2009 | Hashimoto et al. | |
| 8,227,751 | B2 * | 7/2012 | Green | H01J 49/427 250/281 |
| 8,389,933 | B2 | 3/2013 | Hoyes | |
| 8,716,660 | B2 | 5/2014 | Green | |
| 8,946,626 | B2 * | 2/2015 | Giles | H01J 49/421 250/282 |
| 8,987,661 | B2 | 3/2015 | Green et al. | |
| 2009/0134321 | A1 | 5/2009 | Hoyes | |
| 2009/0173880 | A1 * | 7/2009 | Bateman | H01J 49/065 250/292 |
| 2009/0294655 | A1 | 12/2009 | Ding et al. | |
| 2014/0048696 | A1 | 2/2014 | Giles et al. | |

* cited by examiner

Fig. 1A
Prior Art
Fig. 1B
Prior Art
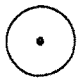
Fig. 1C
Prior Art
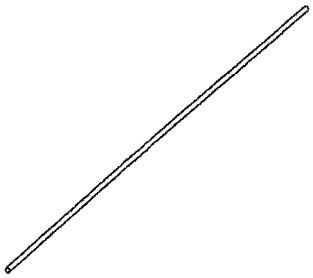
Fig. 1D
Prior Art
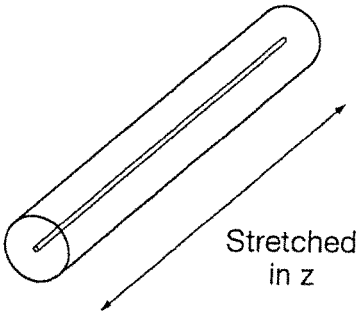
Fig. 1E
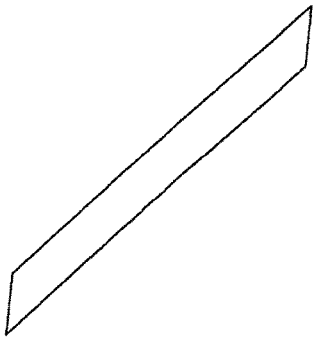
Fig. 1F
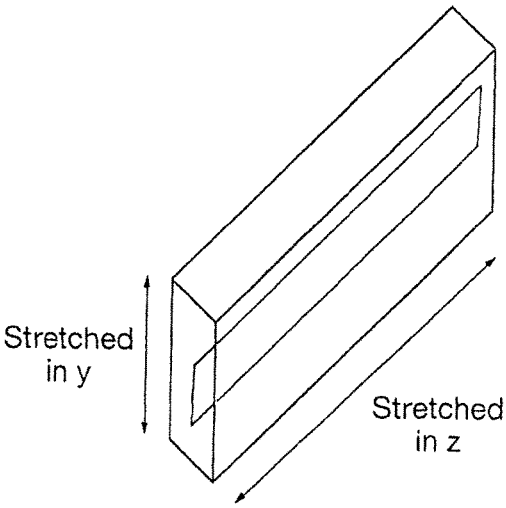

ION TRAP WITH SPATIALLY EXTENDED ION TRAPPING REGION

CROSS-REFERENCE TO RELATED APPLICATIONS

This application is a continuation application of U.S. Ser. No. 14/240,586 which is the National Stage of International Application No. PCT/GB2012/052054, filed 22 Aug. 2012, which claims priority from and the benefit of U.S. Provisional Patent Application Ser. No. 61/528,956 filed on 30 Aug. 2011 and United Kingdom Patent Application No. 1114734.5 filed on 25 Aug. 2011. The entire contents of these applications are incorporated herein by reference.

BACKGROUND OF THE INVENTION

The present invention relates to a mass or mass to charge ratio selective ion trap. The preferred embodiment relates to ion guiding and trapping systems and methodology for use in mass spectrometry systems.

It is well known that the time averaged force on a charged particle or ion due to an AC inhomogeneous electric field is such as to accelerate the charged particle or ion to a region where the electric field is weaker. A minimum in the electric field is commonly referred to as a pseudo-potential well or valley. Correspondingly, a maximum is commonly referred to as a pseudo-potential hill or barrier.

Paul traps, also known as 3D ion traps, are designed to exploit this phenomenon by causing a pseudo-potential well to be formed in the centre of the ion trap. The pseudo-potential well is then used to confine a population of ions. Due to its symmetric nature the 3D ion trap acts to confine ions to a single point in space as shown in FIG. 1A. However, the mutual repulsion between ions of identical polarity in addition to the non-zero kinetic energy of the confined ions lead to the ions occupying a spherical volume at the centre of the ion trap as illustrated in FIG. 1B.

There is a finite space charge capacity for any ion confining device beyond which its performance begins to degrade and where ultimately the device cannot hold any further charges. For example, overfilling an ion trap leads to a loss of mass resolution and of mass accuracy, a result of the electric field becoming distorted by the presence of the large number of charges being focussed into close proximity. It is generally the case that the space charge limit for storage of ions is significantly greater than the spectral or analytical space charge limit which is the maximum number of ions which can be confined whilst retaining a given mass resolution and mass accuracy.

For mass spectrometry applications it is necessary to detect the mass to charge ratio (m/z) of the confined ions. For example, ions may be ejected in a mass selective manner towards an ion detector (although many other detection methods exist). There are several known methods of ejecting ions either resonantly or non-resonantly to achieve this goal.

It is often necessary to introduce gas into ion trapping devices. The gas may be used for cooling purposes or ion fragmentation via Collision Induced Decomposition ("CID"). Ion Mobility Separation ("IMS") has also been performed either with a static volume of gas or with a flow of gas. The use of pulsed gas valves to introduce gas into ion traps is also known.

Recently, there has been increased interest in 2D or Linear Ion Traps ("LIT") because of the increased volume which the confined ions are able to occupy. Linear ion traps allow a greater number of ions, or more correctly a greater number of charges, to be confined and then detected. Such ion traps are generally based on multipolar RF ion guides such as quadrupoles, hexapoles or octopoles. A pseudo-potential well is formed within the rod set ion trap around the central axis of the ion guide so that ions are confined radially within the ion trap. The ions are normally confined axially using DC fields although methods of using RF fields to axially confine ions are also known.

The radial pseudo potential of a 2D ion trap acts to focus the confined ions to a line through the central axis of the ion trap as shown in FIG. 1C. In a similar manner to 3D ion traps, ions confined within a 2D ion trap will in practice be spatially distributed and thus occupy an elongated cylindrical volume as shown in FIG. 1D.

Ion ejection has been demonstrated both radially and axially using 2D ion traps by resonantly exciting the ions within the confining radial pseudo potential. Radial ejection has been achieved by allowing the ions to resonate until their radial excursions reach the quadrupole electrodes at which point they pass through narrow slots in the electrodes. Axial ejection has been achieved by resonantly exciting the ions into the naturally occurring fringing fields which exist at the exit of a quadrupole at which point it is possible for the ions to gain sufficient axial kinetic energy to overcome the confining DC barrier. Both of these methods are inherently non-adiabatic in nature and lead to large ejection energies and large energy spreads which makes them generally unsuitable for coupling with other devices such as other mass analysers.

Another form of axial ejection from a 2D ion trap is known and comprises superimposing an axial harmonic DC potential upon a radial confining RF of an ion guide. Such approaches are schematically represented in FIGS. 2A-C.

FIG. 2A shows a 2D ion trap comprising a series of annular electrodes which coaxially encompass a quadrupole rod set. RF voltages are applied to the rod set electrodes in order to cause ions to be radially confined. DC voltages are applied to the annular electrodes to produce an axial DC potential within the rod set.

FIG. 2B shows a 2D ion trap comprising an RF quadrupole rod set with additional vane electrodes placed on the ground planes which are used to provide an axial DC potential.

FIG. 2C shows a 2D ion trap comprising an axially segmented RF quadrupole rod set. Different DC voltages may be applied to each segment in order to provide an axial DC potential.

With respect to the 2D ion traps shown in FIGS. 2A-2C, the DC potential which is applied in the axial (z) direction is given by Eqn. 1:

$$U_z(t)=(a+b\cdot\cos(\Omega t))\cdot z^2 \tag{1}$$

where b is the electric field constant of the axial quadratic potential, a is the amplitude and Ω is the frequency of the modulation of the axial potential.

$$E_z = \frac{dU_z(t)}{dz} = 2(a + b\cdot\cos(\Omega t))\cdot z \tag{2}$$

$$\ddot{z} + \omega^2 z = F\cdot\cos(\Omega t) \tag{3}$$

$$\omega = \sqrt{\frac{2aq}{m}}$$

and $$F = \frac{2bq}{m}$$

-continued $$z(t) = \frac{F}{\omega^2 - \Omega^2}\sin(\Omega t + \phi) \quad (4)$$

SUMMARY OF THE INVENTION

According to an aspect of the present invention there is provided a mass or mass to charge ratio selective ion trap comprising:

a first device arranged and adapted to generate a radially asymmetric pseudo-potential barrier or well which acts to confine ions in a first (y) and a second (x) direction within the ion trap;

a second device arranged and adapted to generate a substantially DC quadratic potential well which acts to confine ions in a third (z) direction within the ion trap, wherein the profile of the substantially quadratic DC potential well progressively varies along the second (x) direction; and a third device arranged and adapted to excite ions in the third (z) direction so as to mass or mass to charge ratio selectively eject ions in the second (x) direction and/or in the third (z) direction.

According to an aspect of the present invention there is provided a mass or mass to charge ratio selective ion trap comprising:

a first device arranged and adapted to generate a pseudo-potential barrier or well which acts to confine ions in a first (y) direction and a DC potential barrier or well which acts to confine ions in a second (x) direction within the ion trap;

a second device arranged and adapted to generate a substantially DC quadratic potential well which acts to confine ions in a third (z) direction within the ion trap, wherein the profile of the substantially quadratic DC potential well progressively varies along the second (x) direction; and a third device arranged and adapted to excite ions in the third (z) direction so as to mass or mass to charge ratio selectively eject ions in the second (x) direction and/or in the third (z) direction.

The first (y) direction and/or the second (x) direction and/or the third (z) direction are preferably substantially orthogonal.

According to an embodiment the mass or mass to charge ratio selective ion trap comprises a plurality of electrodes.

The plurality of electrodes preferably comprise:

(i) a multipole rod set or a segmented multipole rod set comprising a plurality of or at least 4, 5, 6, 7, 8, 9, 10, 10-20, 20-30, 30-40, 40-50, 50-60, 60-70, 70-80, 80-90, 90-100 or >100 rod sets or segmented rod sets; and/or (ii) an ion tunnel or ion funnel comprising a plurality of or at least 4, 5, 6, 7, 8, 9, 10, 10-20, 20-30, 30-40, 40-50, 50-60, 60-70, 70-80, 80-90, 90-100 or >100 annular, ring or oval electrodes having one or more apertures through which ions are transmitted in use; and/or (iii) a plurality of or at least 4, 5, 6, 7, 8, 9, 10, 10-20, 20-30, 30-40, 40-50, 50-60, 60-70, 70-80, 80-90, 90-100 or >100 half annular, half ring, half oval or C-shaped electrodes; and/or (iv) a stack or array of planar, plate or mesh electrodes arranged generally in the plane in which ions travel in use.

The first device is preferably arranged and adapted to apply an RF voltage to at least some of the electrodes.

The ion trap is preferably arranged and adapted so that there is a full and/or direct line of sight through the ion trap in the third (z) direction.

The ion trap is preferably arranged and adapted so that there is a full and/or direct line of sight through the ion trap in the second (x) direction.

The second device is preferably arranged and adapted to form the substantially quadratic DC potential well so that either: (i) a minimum of the substantially quadratic DC potential well is along a central axis of the ion trap; or (ii) a minimum of the substantially quadratic DC potential well is offset from a central axis of the ion trap.

The pseudo-potential barrier or well preferably comprises a non-quadrupolar pseudo-potential barrier or well.

The third device is preferably arranged and adapted to cause ions to oscillate in the third (z) direction, and the amplitude of oscillation of the ions in the third (z) direction is preferably dependent on the mass or mass to charge ratio of the ions.

An electric field is preferably maintained along the second (x) direction.

The electric field preferably progressively increases, decreases or varies along the second (x) direction.

The electric field preferably urges, channels or directs ions towards an ion ejection region of the ion trap. Ions are preferably mass or mass to charge ratio selectively ejected in the second (x) direction and/or in the third (z) direction from the ion ejection region.

The magnitude of the electric field in the second (x) direction preferably increases, decreases or varies with position in the third (z) direction.

The electric field preferably causes ions to experience substantially different acceleration fields in the second (x) direction dependent upon the relative position of the ions in the third (z) direction.

The electric field preferably urges ions having a particular mass or mass to charge ratio or ions having a mass or mass to charge ratio within a particular range in the second (x) direction prior to the ions being mass or mass to charge ratio selectively ejected in the third (z) direction.

The electric field preferably urges ions in the second (x) direction with a force dependent on the amplitude of oscillation of the ions in the third (z) direction prior to the ions being mass or mass to charge ratio selectively ejected in the second (x) direction and/or in the third (z) direction.

Ions are preferably confined in the third (z) direction by the DC quadratic potential well and the height of at least one side of the well preferably decreases with position in the second (x) direction towards the ejection region such that ions having an amplitude of oscillation in the third (z) direction are confined by the ion trap in a region away from the ejection region in the second (x) direction, whereas ions in the ejection region having the same amplitude of oscillation in the third (z) direction are able to surmount the DC potential well and are ejected from the ion trap.

The second device is preferably arranged and adapted to maintain the substantially DC quadratic potential well across some but not all electrodes arranged in the third (z) direction.

The second device is preferably arranged and adapted to maintain a substantially DC quadratic potential well across x % of the width of the ion trap in the third (z) direction, wherein x is selected from the group consisting of: (i) <10; (ii) 10-20; (iii) 20-30; (iv) 30-40; (v) 40-50; (vi) 50-60; (vii) 60-70; (viii) 70-80; (ix) 80-90; (x) 90-95; and (xi) 95-99.

The second device is preferably arranged and adapted to maintain a DC potential profile in the third (z) direction across the ion trap wherein the DC potential profile comprises a first region and one or more second regions, wherein the DC potential profile in the first region is substantially quadratic and wherein the DC potential profile in the one or more second regions is substantially linear, constant or non-quadratic.

The second device is preferably arranged and adapted to maintain a DC potential profile in the third (z) direction which is asymmetric preferably about a central axis of the ion trap, wherein the central axis is preferably in the second (x) direction.

The second device is preferably arranged and adapted to maintain a DC potential profile in the third (z) direction which results in ions being ejected from the substantially DC quadratic well in one direction only.

The third device is preferably arranged and adapted so that ions are mass or mass selectively ejected from the ion trap either: (i) in a first direction only; or (ii) both in a first direction and a second direction, wherein the second direction is different to or opposed to the first direction.

The third device is preferably arranged and adapted to excite ions resonantly in the third (z) direction.

The third device is preferably arranged and adapted to apply a supplemental AC voltage or potential to at least some of the electrodes having a frequency $\sigma$ which is equal to $\omega$, wherein $\omega$ is the fundamental or resonance frequency of ions which are desired to be ejected from the ion trap.

The third device is preferably arranged and adapted to excite ions parametrically in the third (z) direction.

The third device is preferably arranged and adapted to apply a supplemental AC voltage or potential to at least some of the electrodes having a frequency $\sigma$ equal to $2\omega$, $0.667\omega$, $0.5\omega$, $0.4\omega$, $0.33\omega$, $0.286\omega$, $0.25\omega$ or $<0.25\omega$, wherein $\omega$ is the fundamental or resonance frequency of ions which are desired to be ejected from the ion trap.

The third device is preferably arranged and adapted to scan, vary, alter, increase, progressively increase, decrease or progressively decrease the frequency $\sigma$ of the supplemental AC voltage or potential.

The third device is preferably arranged and adapted: (i) in a mode of operation to eject ions from the ion trap in order of their mass to charge ratio; and/or (ii) in a mode of operation to eject ions from the ion trap in reverse order of their mass to charge ratio.

The third device is preferably arranged and adapted to cause ions to be ejected from the ion trap in a substantially adiabatic manner.

The third device is preferably arranged and adapted to cause ions to be ejected from the ion trap with an ion energy selected from the group consisting of: (i) <0.5 eV; (ii) 0.5-1.0 eV; (iii) 1.0-1.5 eV; (iv) 1.5-2.0 eV; (v) 2.0-2.5 eV; (vi) 2.5-3.0 eV; (vii) 3.0-3.5 eV; (viii) 3.5-4.0 eV; (ix) 4.0 eV-4.5 eV; (x) 4.5-5.0 eV; and (xi) >5.0 eV.

The ion trap is preferably arranged and adapted to contain N ion charges within the ion trap, wherein N is selected from the group consisting of: (i) $<5\times10^4$; (ii) $5\times10^4$-$1\times10^5$; (iii) $1\times10^5$-$2\times10^5$; (iv) $2\times10^5$-$3\times10^5$; (v) $3\times10^5$-$4\times10^5$; (vi) $4\times10^5$-$5\times10^5$; (vii) $5\times10^5$-$6\times10^5$; (viii) $6\times10^5$-$7\times10^5$; (ix) $7\times10^5$-$8\times10^5$; (x) $8\times10^5$-$9\times10^5$; (xi) $9\times10^5$-$1\times10^6$; and (xii) $>1\times10^6$.

In a mode of operation at least a region or substantially the whole of the ion trap is preferably arranged and adapted to be operated:

(i) as an ion guide; and/or (ii) as a collision or fragmentation cell; and/or (iii) as a reaction cell; and/or (ii) as a mass filter; and/or (iii) as a time of flight separator; and/or (iv) as an ion mobility separator; and/or (v) as a differential ion mobility separator.

In a mode of operation the ion trap is preferably arranged and adapted to be maintained at a pressure selected from the group consisting of: (i) $<1.0\times10^{-7}$ mbar; (ii) $1.0\times10^{-7}$-$1.0\times10^{-6}$ mbar; (iii) $1.0\times10^{-6}$-$1.0\times10^{-5}$ mbar; (iv) $1.0\times10^{-5}$-$1.0\times10^{-4}$ mbar; (v) $1.0\times10^{-4}$-$1.0\times10^{-3}$ mbar; (vi) 0.001-0.01 mbar; (vii) 0.01-0.1 mbar; (viii) 0.1-1 mbar; (ix) 1-10 mbar; (x) 10-100 mbar; and (xi) 100-1000 mbar.

According to an aspect of the present invention there is provided a mass spectrometer comprising a mass or mass to charge ratio selective ion trap as described above.

According to an aspect of the present invention there is provided a method of mass or mass to charge ratio selective ejection of ions from an ion trap comprising:

generating a radially asymmetric pseudo-potential barrier or well which acts to confine ions in a first (y) and a second (x) direction within the ion trap;

generating a substantially DC quadratic potential well which acts to confine ions in a third (z) direction within the ion trap, wherein the profile of the substantially quadratic DC potential well progressively varies along the second (x) direction; and exciting ions in the third (z) direction so as to mass or mass to charge ratio selectively eject ions in the second (x) direction and/or in the third (z) direction.

According to an aspect of the present invention there is provided a method of mass or mass to charge ratio selective ejection of ions from an ion trap comprising:

generating a pseudo-potential barrier or well which acts to confine ions in a first (y) direction and a DC potential barrier or well which acts to confine ions in a second (x) direction within the ion trap;

generating a substantially DC quadratic potential well which acts to confine ions in a third (z) direction within the ion trap, wherein the profile of the substantially quadratic DC potential well progressively varies along the second (x) direction; and exciting ions in the third (z) direction so as to mass or mass to charge ratio selectively eject ions from the ion trap in the second (x) direction and/or in the third (z) direction.

According to an aspect of the present invention there is provided a method of mass spectrometry comprising a method as described above.

According to an aspect of the present invention there is provided an ion trap with a trapping volume which is spatially extended in two spatial dimensions from which ions of a chosen mass to charge ratio are moved from the whole volume into a smaller ejection region prior to their ejection from the ion trap.

Despite the larger ion capacity of 2D ion traps over 3D ion traps, the need for ion traps with increased ion capacity grows as instruments become more sensitive and ion sources become brighter.

The preferred embodiment comprises an ion trap or ion transmission device with an enlarged trapping or transmitting volume. According to an embodiment the ion trap comprises a 1D ion trap which is arranged to confine and eject ions and which has a greater ion charge capacity than conventional 3D and 2D ion traps.

In the same way that a 3D ion trap fundamentally confines ions to a point and a 2D ion trap fundamentally confines ions to a line, the 1D ion trap according to the preferred embodiment fundamentally confines ions to a plane as shown in FIG. 1E. However, in practice the actual volume occupied by the ions will expand to fill a rectangular prism which is elongated in two spatial dimensions as shown in FIG. 1F.

An ion trap according to a preferred embodiment of the present invention comprises an array of electrodes which define an extended volume to which various combinations of RF, AC and DC voltages may be applied. The ion trap may act as either an ion transmission device or as an ion trap. The ion trap may be used to hold, accumulate, store, process, isolate, fragment, detect and eject ions. In operation some or all of the ions are distributed within the extended trapping region and may be moved in a mass to charge ratio dependent manner towards a specific region of the ion trap from which they may be subsequently ejected. Ion ejection is preferably effected by exciting the ions within a substantially DC quadratic potential. The form of the quadratic potential varies along the length of the device such that it is steeper in some regions and shallower in other regions. The act of exciting the ion leads to the ions being squeezed from the steeper regions into the shallower regions from where the ions are finally ejected.

The ion trap may be operated as a mass analyser or may be used in conjunction with a mass analyser or other devices within a mass spectrometer.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

An RF voltage is preferably applied to the electrodes of the preferred ion trap and preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak.

The RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The ion trap is preferably maintained at a pressure selected from the group comprising: (i) >0.001 mbar; (ii) >0.01 mbar; (iii) >0.1 mbar; (iv) >1 mbar; (v) >10 mbar; (vi) >100 mbar; (vii) 0.001-0.01 mbar; (viii) 0.01-0.1 mbar; (ix) 0.1-1 mbar; (x) 1-10 mbar; and (xi) 10-100 mbar.

BRIEF DESCRIPTION OF THE DRAWINGS

Various embodiments of the present invention together with other arrangements given for illustrative purposes only will now be described, by way of example only, and with reference to the accompanying drawings in which:

FIG. 1A shows the volume occupied by ions in theory in a 3D ion trap, FIG. 1B shows the volume occupied by ions in practice in a 3D trap, FIG. 1C shows the volume occupied by ions in theory in a 2D ion trap, FIG. 1D shows the volume occupied by ions in practice in a 2D ion trap, FIG. 1E shows the volume occupied by ions in theory in a 1D ion trap according to an embodiment of the present invention and FIG. 1F shows the volume occupied by ions in practice in a 1D ion trap according to an embodiment of the present invention;

DETAILED DESCRIPTION OF THE PREFERRED EMBODIMENTS

Figure 2A:
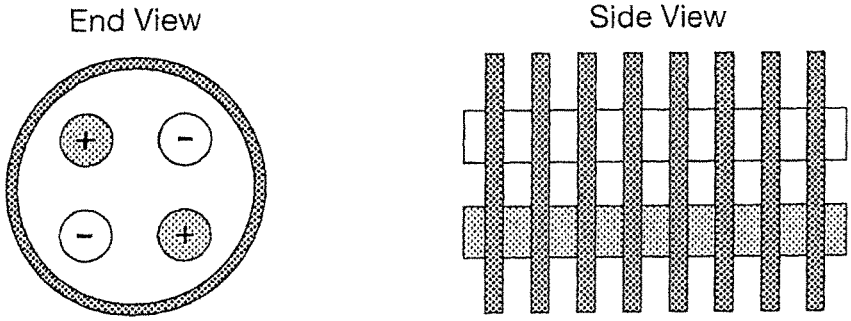
Fig. 2A Prior Art
FIG. 2A shows a known linear or 2D ion trap comprising a plurality of annular electrodes surrounding a quadrupole rod set.
Figure 2B:
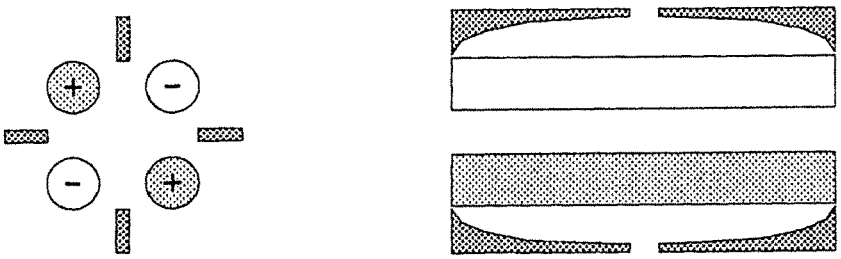
Fig. 2B Prior Art
FIG. 2B shows a known linear or 2D ion trap comprising a quadrupole rod set with vane electrodes and FIG. 2C shows a known linear or 2D ion trap comprising a segmented quadrupole rod set.
Figure 2C:
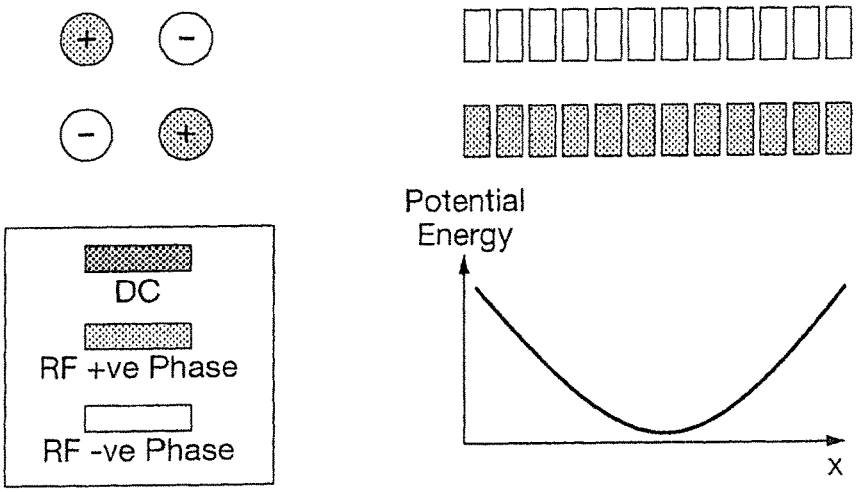
Fig. 2C Prior Art
Figure 3A:
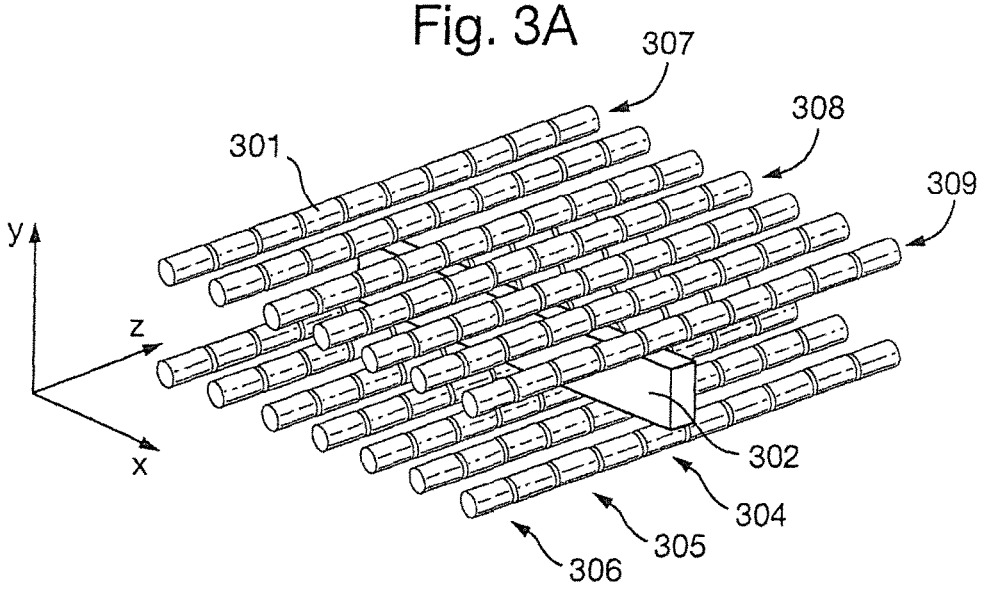
FIG. 3A shows an ion trap according to a preferred embodiment of the present invention.

An ion trap according to a preferred embodiment of the present invention is shown in FIG. 3A. The ion trap consists of an extended three dimensional array of electrodes 301. According to an embodiment the electrodes comprise segmented rod electrodes.

The ion trap can be considered as comprising two horizontal layers of electrodes. Ions are confined in the vertical (y) direction (i.e. between the two horizontal layers of electrodes) by applying an RF voltage to the electrodes. Ions are confined in the vertical (y) direction by a non-quadrupolar pseudo-potential.

Figure 3B:
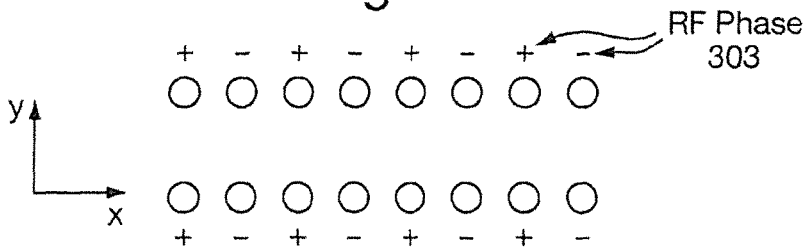
FIG. 3B shows an end on view of the preferred ion trap and FIG. 3C shows a side view of the preferred ion trap.

FIG. 3B shows an end on view of the segmented rod electrodes. According to the preferred embodiment all the segmented electrodes which conceptually form a rod are preferably maintained at the same phase of the RF voltage. Horizontally adjacent segmented rod electrodes are preferably maintained at opposite RF phases. Segmented rod electrodes in the upper layer are preferably maintained at the same RF phase as corresponding segmented rod electrodes in the lower layer.

With reference to FIG. 3B, ion confinement in the x-z plane is preferably achieved by applying opposite phases of a RF voltage 303 to adjacent rows of electrodes in the x direction.

Figure 3C:
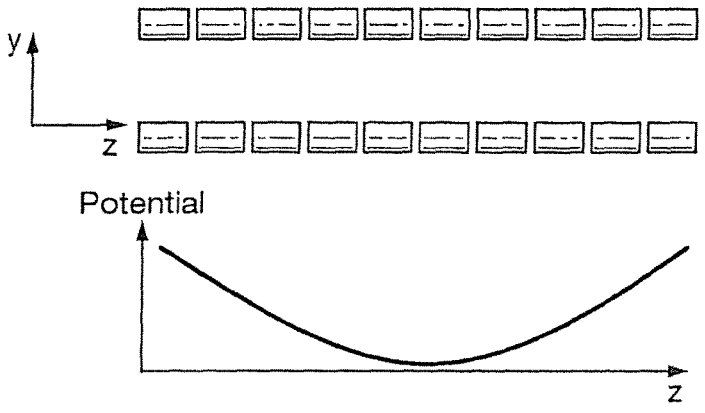

FIG. 3C shows a side view of the electrode positions to aid in the visualisation of the entire structure.

A quadratic DC potential is preferably maintained in the z-direction by applying a quadratic DC potential to the electrodes in the z-direction. As a result, ions are preferably confined in an ion volume 302 which is shown in FIG. 3A as a rectangular prism.

Ions may initially enter the ion trap in the z-direction and then the quadratic DC potential may be applied to the electrodes in the z-direction. Alternatively, the quadratic DC potential may be applied to the electrodes in the z-direction and ions may enter the ion trap in the x-direction.

Figure 4A:
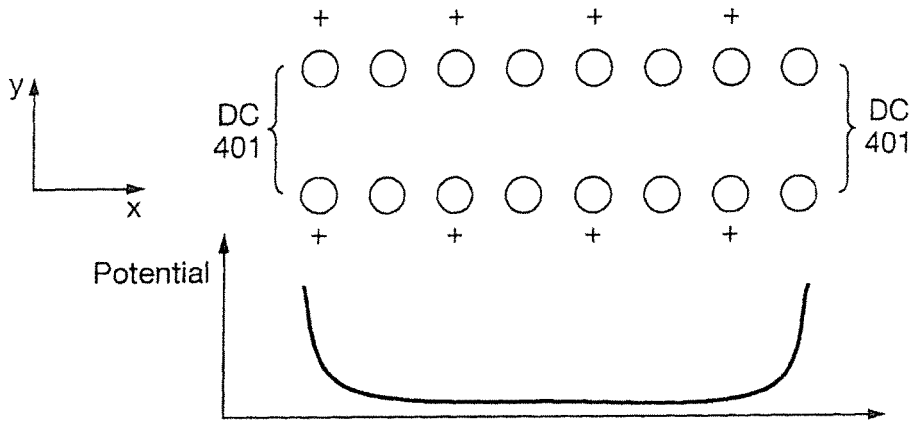
FIG. 4A shows how ions may be confined in the x-direction within the preferred ion trap by applying a DC voltage to end pairs of electrodes.
Figure 4B:
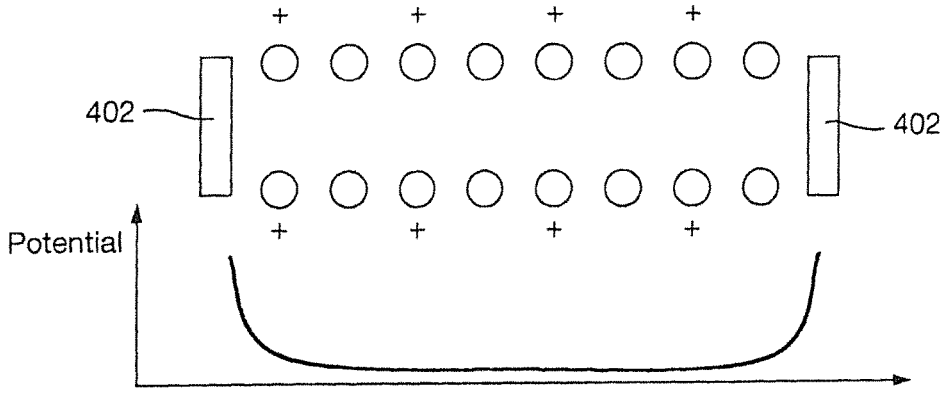
FIG. 4B shows how ions may be confined in the x-direction within the preferred ion trap by applying a DC voltage to additional end plate electrodes and FIG. 4C shows how ions may by confined in the x-direction within the preferred ion trap by applying a RF voltage to additional rod electrodes.
Figure 4C:
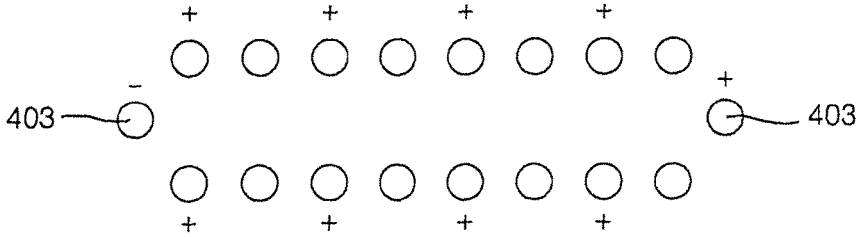

With reference to FIGS. 4A-4C a number of different techniques may be used to confine ions axially within the ion trap in the x-direction.

FIG. 4A shows a preferred embodiment of the present invention wherein ions are confined axially within the ion trap in the x-direction by applying a supplemental DC potential 401 to the end or outermost pairs of electrodes in the y-z plane. According to this embodiment ions may enter the ion trap initially in either the x- or z-directions.

FIG. 4B shows an alternative embodiment wherein a DC potential may be applied to additional end plate electrodes 402. According to this embodiment ions initially enter the ion trap via the z-direction. Once ions have entered the ion trap a quadratic potential is then preferably maintained in the z-direction.

FIG. 4C shows another alternative embodiment wherein additional segmented or non-segmented rod set electrodes 403 are provided. The RF voltage applied to the segmented rod set electrodes 301 is also preferably applied to the additional electrodes 403 so that ions are confined axially in the x-direction within the ion trap by a pseudo-potential barrier or well. According to this embodiment ions initially enter the ion trap via the z-direction. Once ions have entered the ion trap a quadratic potential is then preferably maintained in the z-direction.

According to a preferred embodiment a DC quadratic potential is preferably superimposed on the RF voltages applied to the electrodes in the z-direction such that a DC potential well is formed in the z-direction as shown in FIG. 3C. The DC quadratic potential may be applied to electrodes so that a quadratic potential well is maintained in the z-direction before or after ions have entered the ion trap.

The form of the quadratic potential or DC potential well in the z-direction preferably varies across or along the length of the ion trap.

An example of how the quadratic potential may vary across or along the length of the ion trap will now be described in further detail with reference to FIGS. 5A-C.

Figure 5A:
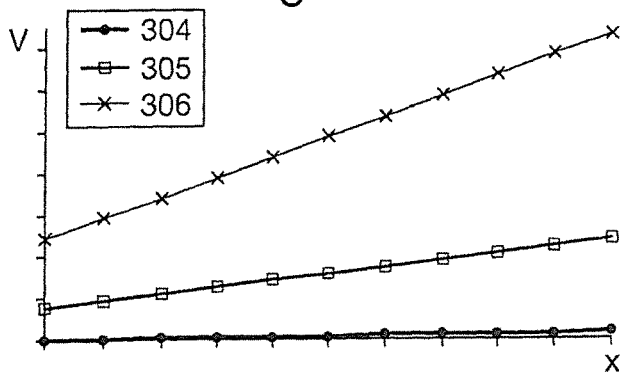
FIG. 5A shows how according to a preferred embodiment the DC potential applied to three groups of electrodes varies along the x-direction.

FIG. 5A shows a plot of the applied potential along the three lines of electrodes labelled 304,305,306 in FIG. 3A wherein the three lines of electrodes have different displacements in the z-direction. It is apparent from FIG. 5A that the electrodes 304 arranged towards the centre of the ion trap have a low or zero potential gradient in the z-direction whereas the electrodes 306 arranged furthermost from the centre of the ion trap have a high potential gradient. The effect is to provide an electric field which funnels or directs ions towards the centre of the ion trap in the z-direction and which also directs ions towards one end of the ion trap having a displacement of zero in the x-direction. The magnitude of the electric field in the x-direction preferably varies with position in the z-direction, so that the electric field preferably causes ions to experience substantially different acceleration fields in the x-direction dependent upon the relative position of the ions in the z-direction.

Figure 5B:
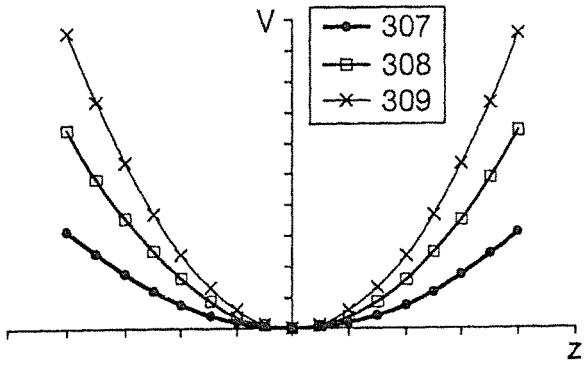
FIG. 5B shows how the DC potential varies in the z-direction and FIG. 5C shows a 3D representation of the DC potential in the x-z plane.

FIG. 5B shows a plot of the applied potential along the three lines of electrodes labelled 307,308,309 in FIG. 3A wherein the three lines of electrodes 307,308,309 have different displacements in the x-direction The electrodes 307 having a displacement closest to zero in the x-direction have a shallow quadratic potential maintained across them in the z-direction whereas the electrodes 309 arranged with the maximum displacement in the x-direction have a deep quadratic potential maintained across them in the z-direction.

Figure 5C:
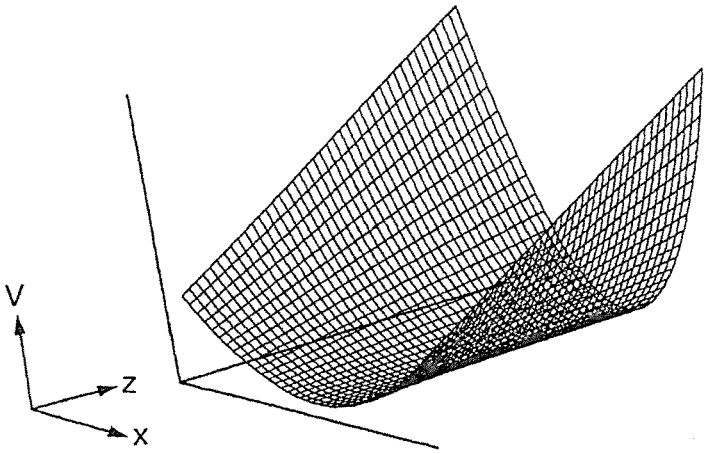

FIG. 5C shows a 3D plot of the applied potential to aid the visualisation of the applied potential.

Embodiments of the present invention are contemplated wherein ions are mass or mass to charge ratio selectively ejected from the preferred ion trap in the z-direction in one direction only. In alternative embodiments, ions are mass or mass to charge ratio selectively ejected from the preferred ion trap in the x-direction only or in both the x-direction and in the z-direction. According to an embodiment the quadratic potential which is maintained in the z-direction may be asymmetric in the sense that a quadratic potential may be maintained across a majority of the electrodes but some of the electrodes on one side of the ion trap may be maintained at a constant potential. As a result, a quadratic potential may be maintained which is effectively truncated on one side of the potential well in the z-direction. It will be apparent, therefore, that the maximum potential on one side of the potential well may be greater than the maximum potential on the other side of the potential well.

An ion trap according to the preferred embodiment may be used in several different modes of operation.

Figure 6A:
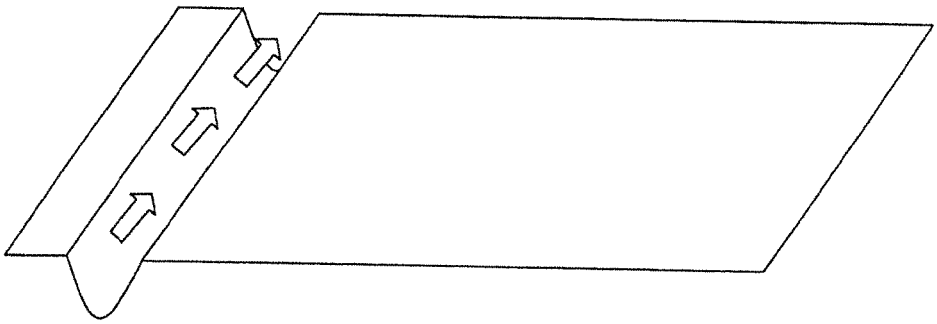
FIG. 6A shows a mode of operation wherein an ion channel is formed in the preferred ion trap and FIG. 6B shows a preferred embodiment of the present invention wherein ions are mass to charge ratio selectively urged in the x-direction and are then mass to charge ratio selectively ejected from the ion trap in the z-direction.

In a mode of operation the ion trap may be used as an ion transmission device and/or as a collision cell. This may be achieved by applying appropriate DC potentials to the electrodes so that one or more ion transmission channels exist through which ions may pass. FIG. 6A shows an embodiment wherein the ion trap is operated as an ion guide and/or as a collision cell.

Figure 6B:
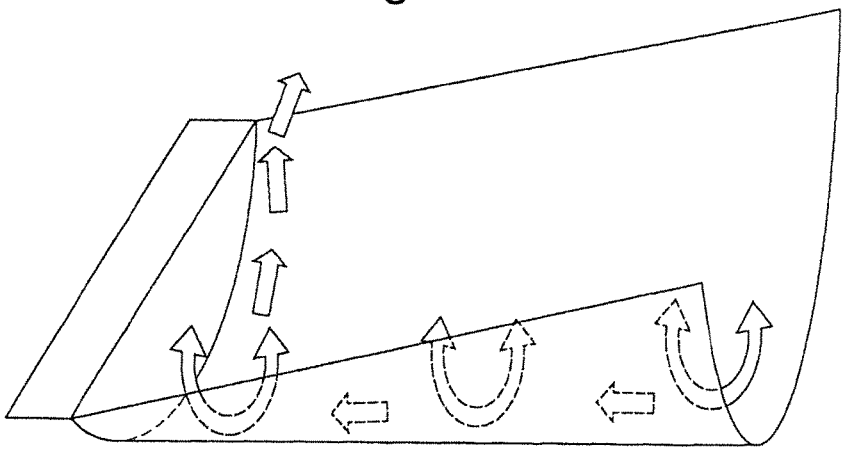
Figure 6B:
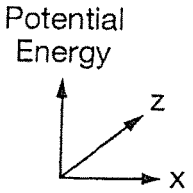

FIG. 6B shows a preferred embodiment wherein ions are ejected from the ion trap in the z-direction. DC quadratic potentials are preferably applied to the electrodes in the z-direction in the manner as shown and described above in relation to FIG. 5.

An AC or tickling voltage is preferably applied to the electrodes in order to resonantly excite the ions within the ion trap. Application of the AC or tickling voltage preferably causes ions to oscillate in the z-direction. The amplitude of oscillation of the ions in the z-direction is preferably dependent on the mass or mass to charge ratio of the ions. As discussed above, the electric field causes ions to experience substantially different acceleration fields in the x-direction dependent upon the relative position of the ions in the z-direction. Thus, the electric field urges ions in the x-direction with a force dependent on the amplitude of oscillation of the ions in the z-direction, which in turn depends on the mass or mass to charge ratio of the ions.

Thus, the application of the AC or tickling voltage in combination with the electric field preferably results in ions being pushed in a mass to charge ratio dependent manner from within the bulk of the ion trap towards one region of the ion trap (i.e. towards the left hand side of the ion trap in the x-direction as shown in FIG. 6B). The ion trap is preferably arranged such that ions cannot be ejected from anywhere except from the specified ion ejection region. Ions are preferably confined in the z-direction by the DC quadratic potential well and the height of at least one side of the well decreases with position in the x-direction towards the ejection region such that ions having an amplitude of oscillation in the z-direction are confined by the ion trap in a region away from the ejection region in the x-direction, whereas ions in the ejection region having the same amplitude of oscillation in the z-direction are able to surmount the DC potential well and are ejected from the ion trap. Ions ejected from the ion trap may be detected directly or else may be passed to further RF devices and/or mass analysers for further processing or detection.

Figure 7A:
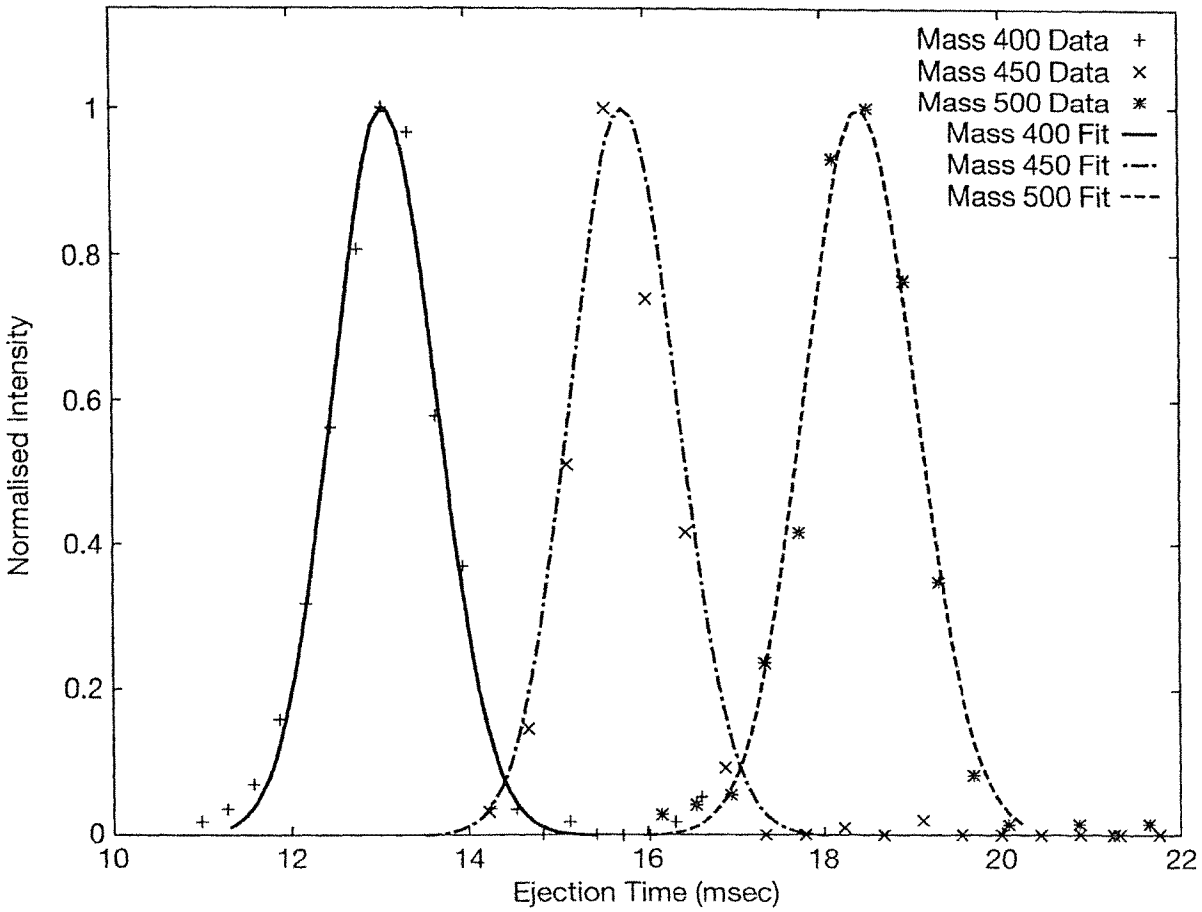
FIG. 7A shows the result of a SIMION® simulation modelling the ejection of ions from a preferred ion trap wherein the effects of space charge were not included and FIG. 7B shows the result of a SIMION® simulation when the effects of space charge were included.

The preferred ion trap has been modelled using the ion optical modelling package SIMION®. FIG. 7A shows a plot of the ejection time of ions from the preferred ion trap for three groups of ions which were modelled as having mass to charge ratios of 400, 450 and 500 Da. Space charge effects were neglected in this instance. It is apparent that ions having a mass to charge ratios of 400 were initially ejected, followed by ions having a mass to charge ratio of 450 followed by ions having a mass to charge ratio of 500.

Identical simulations were also performed wherein approximately $1\times10^6$ charges were included within the ion trap to ascertain the effect of a very large space charge within the ion trap. By way of comparison it is known that the performance of conventional 3D ion traps becomes degraded when the number of charges within the ion trap is of the order of $1\times10^3$. The equivalent number for 2D or linear traps has previously been determined to be of the order of $5\times10^4$.

Figure 7B:
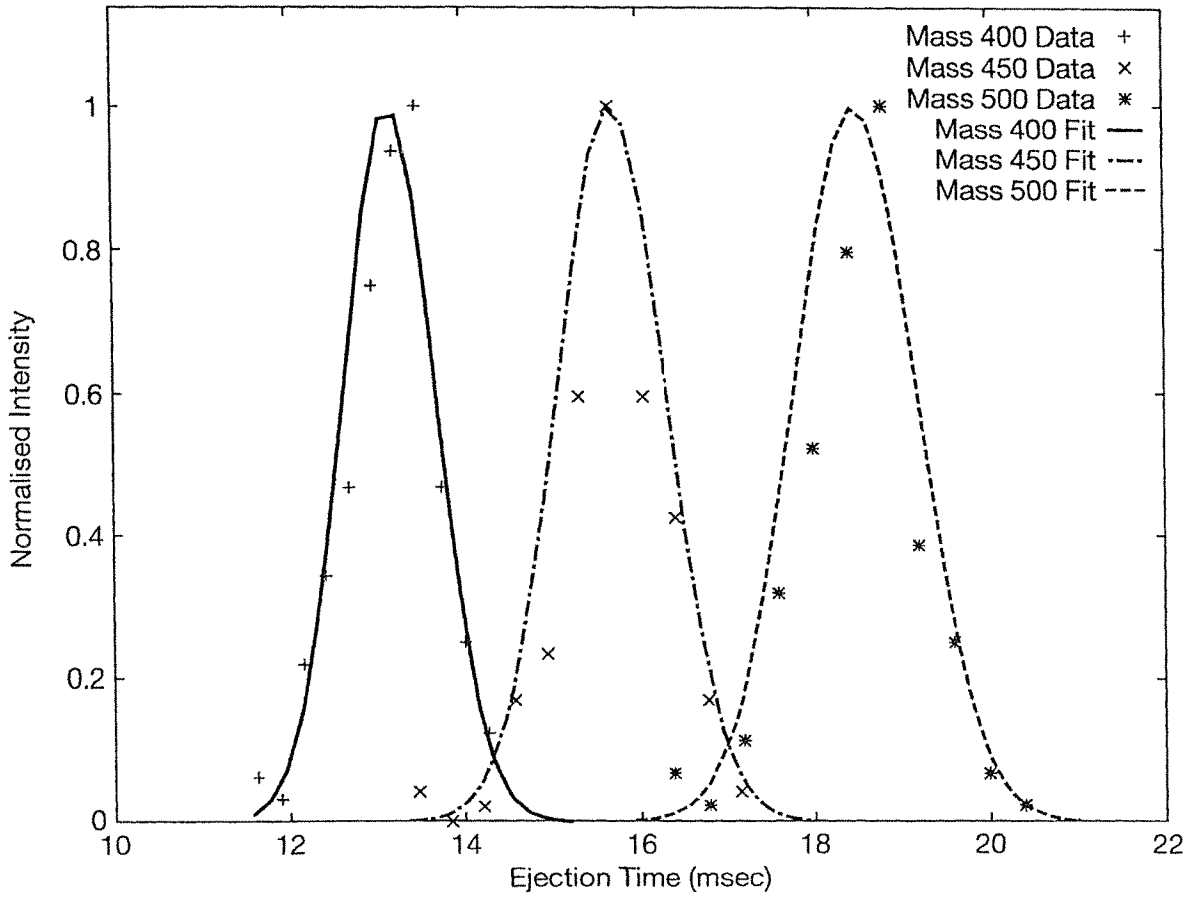

FIG. 7B shows the ejection times for the SIMION® simulations where space charge effects were included. Neither the peak ejection times nor the peak widths (and hence the resolution of the ion trap) were unduly affected due to the presence of such a large amount of space charge.

Accordingly, as will be apparent from comparing FIGS. 7A and 7B, the preferred ion trap having an extended ion confinement volume is particularly advantageous compared to conventional 2D and 3D ion traps.

Figure 8:
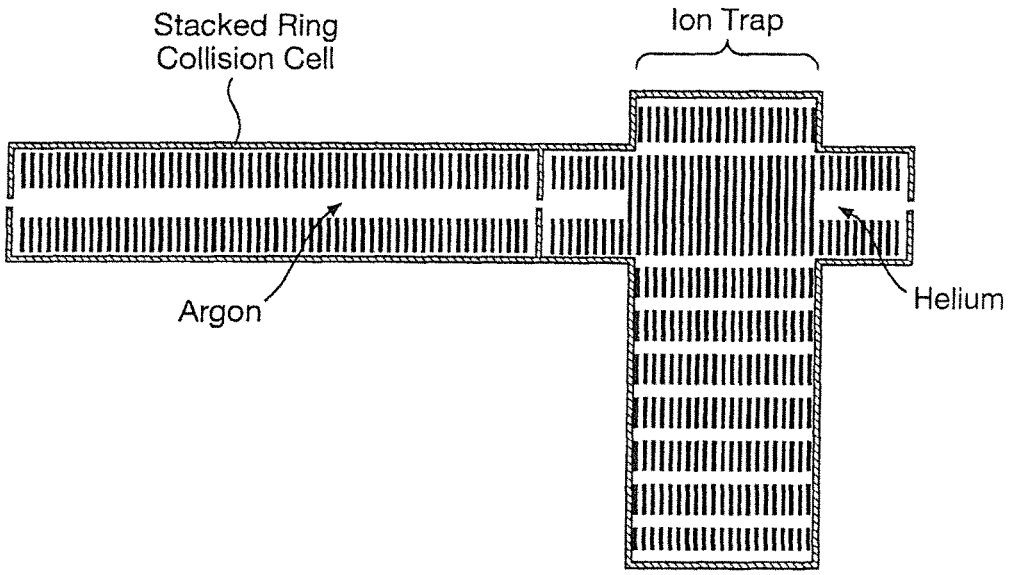
FIG. 8 shows an embodiment wherein the preferred ion trap is integrated with a Stacked Ring Ion Guide ("SRIG") collision cell.

FIG. 8 shows another embodiment of the present invention wherein a preferred ion trap is integrated with a Stacked Ring Ion Guide ("SRIG") collision cell. The stacked ring ion guide preferably contains argon gas for good fragmentation efficiency whereas the preferred ion trap preferably contains helium gas for good ejection efficiency. The collision cell and ion trap may be used in tandem as a single ion transmission and/or collision cell.

Alternatively, the collision cell and ion trap may be used separately i.e. the collision cell may be used to fragment and/or accumulate ions and the ion trap may be used to hold and eject ions accumulated in the stacked ring ion guide.

FIGS. 9A-D show examples of instrument geometries according to various embodiments of the present invention. It will be apparent to those skilled in the art that there are many more potential configurations beyond these examples.

Figure 9A:
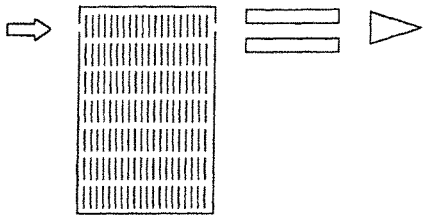
FIG. 9A shows an embodiment wherein a source of ions is followed by a preferred ion trap, a quadrupole and an ion detector.

FIG. 9A shows an embodiment wherein a source of ions is followed by an ion trap according to the preferred embodiment followed by a quadrupole followed by an ion detector.

Figure 9B:
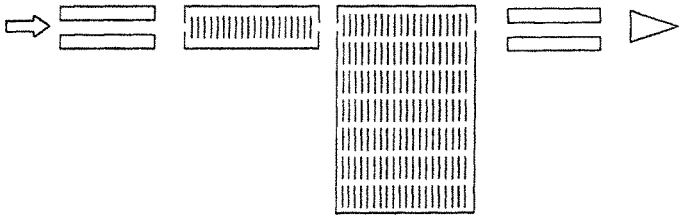
FIG. 9B shows an embodiment wherein a source of ions is followed by a quadrupole, a collision cell, a preferred ion trap, a further quadrupole and an ion detector.

FIG. 9B shows an embodiment comprising a source of ions followed by a quadrupole, followed by a collision cell, followed by an ion trap according to the preferred embodiment, followed by a second quadrupole and an ion detector.

Figure 9C:
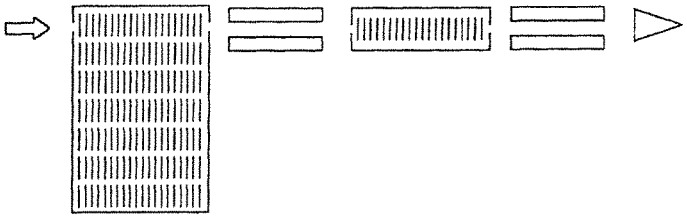
FIG. 9C shows an embodiment wherein a source of ions is followed by a preferred ion trap, a quadrupole, a collision cell, a further quadrupole and an ion detector

FIG. 9C shows an embodiment comprising a source of ions followed by an ion trap according to a preferred embodiment, followed by a quadrupole, followed by a collision cell, followed by a second quadrupole and an ion detector.

Figure 9D:
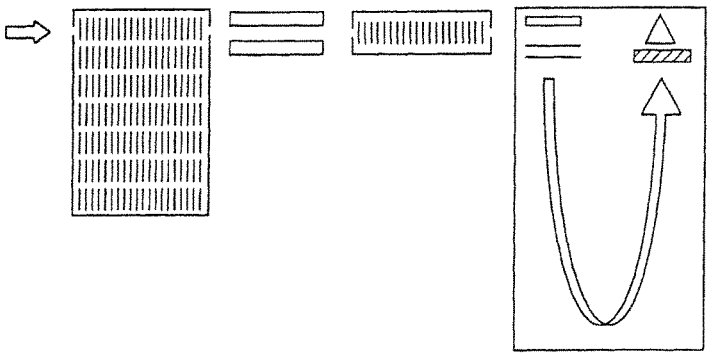
FIG. 9D shows an embodiment wherein a source of ions is followed by a preferred ion trap, a quadrupole, a collision cell and a Time of Flight mass analyser.

FIG. 9D shows an embodiment comprising a source of ions followed by an ion trap according to a preferred embodiment, followed by a quadrupole, followed by a collision cell and a Time of Flight mass analyser.

It will be apparent that various modifications may be made to the particular embodiments discussed above without departing from the scope of the invention.

For example, embodiments are contemplated wherein the electrodes comprising the ion trap may comprise electrodes which are not rod shaped. For example, the electrodes may comprise a plurality of stacked plate electrodes, a plurality of stacked ring electrodes, a plurality of half ring electrodes of a plurality of C-shaped electrodes.

According to a less preferred embodiment the applied DC potential may be non-quadratic.

According to an embodiment, the DC potential well may be deeper on one side of the ion trap than on the other side of the ion trap. As a result, ions are preferably ejected in one direction rather than being ejected in two directions.

According to an embodiment, the direction of exit of ions from the ion trap may be changed by changing the depth of the DC well appropriately such that all or a selection of ions preferably exit one way or all or a selection of ions preferably exit the other way.

According to an embodiment, the ion trap may be operated in a linked scanning mode of operation with the mass to charge ratio ejection of ions from the DC well linked with the m/z scan of an adjacent mass analyser.

According to an embodiment, there may be more than one ejection region.

According to an embodiment, ions may be injected in one place and either ejected from the same location or from another spatially distinct region.

According to an embodiment more than one ion compression region may be provided i.e. ions may be stored in wings and then moved in an mass to charge ratio manner into a central ejection region.

Although the present invention has been described with reference to preferred embodiments, it will be understood by those skilled in the art that various changes in form and detail may be made without departing from the scope of the invention as set forth in the accompanying claims.

The invention claimed is:

1. An ion trapping or guiding device comprising:

an array of electrodes comprising a first layer of electrodes and a second layer of electrodes, wherein said first and second layers of electrodes are spaced apart in a first (y) direction and are substantially parallel to each other and to a plane orthogonal to said first (y) direction and extending in a second (x) and a third (z) direction; and one or more voltage sources arranged and adapted to apply one or more voltages to said array of electrodes so as to generate a substantially quadratic DC potential that acts to confine ions within an ion trapping volume in said third (z) direction and a DC potential barrier or well which acts to confine ions within said ion trapping volume in said second (x) direction in order to confine ions substantially within said ion trapping volume wherein ions are fundamentally confined to a plane defined by said first (y) and said second (x) directions but expand to fill a substantially rectangular prism which is spatially elongated at least in the second (x) direction, wherein said first and second layers each comprise a plurality of segmented rod electrodes extending in the third (z) direction.

2. The device of claim 1, wherein ions are ejected or separated in the third (z) direction.

3. The device of claim 1, wherein said ion trapping volume acts to substantially confine ions to a plane orthogonal to said third (z) direction.

4. The device of claim 1, wherein a dimension of said substantially rectangular prism in said second (x) direction is larger than a dimension in the first (y) direction.

5. The device of claim 4, wherein the dimension of said substantially rectangular prism in said first (y) direction is larger than a dimension in the third (z) direction.

6. The device of claim 1, wherein said one or more voltage sources are arranged and adapted to apply one or more voltages so as to cause ions of a selected mass to charge ratio to move from a first region of said ion trapping volume to a second region of said ion trapping volume wherein ions are ejected, in use, from said second region.

7. The device of claim 6, wherein said one or more voltage sources are arranged and adapted to apply one or more voltages for exciting ions within said second region in order to eject said ions from said second region.

8. The device of claim 1, wherein said one or more voltage sources are arranged and adapted to apply one or more RF voltages to generate a pseudo-potential barrier or well which acts to confine ions within said ion trapping volume in said first (y) direction.

9. The device of claim 1, wherein the form of said substantially quadratic DC potential varies across or along the length of the device such that said substantially quadratic DC potential is steeper in a first region of said ion trapping volume and shallower in a second region of said ion trapping volume.

10. The device of claim 9, wherein, in use, ions are caused to move from said first regions into said second regions, wherein ions are ejected from said second regions.

11. The device of claim 1, wherein said one or more voltage sources are arranged and adapted to apply one or more RF voltages to generate one or more pseudo-potential barriers or wells which act to confine ions within said ion trapping volume in said second (x) direction.

12. The device of claim 1, wherein said one or more voltage sources are arranged and adapted to generate one or more DC potentials which act to create one or more ion transmission channels through the device.

13. The device of claim 1, wherein said one or more voltages act to substantially confine ions between said first and second layers of electrodes within a plane orthogonal to said third (z) direction, and wherein the spatial extent of the ion trapping volume in the third (z) direction is determined at least in part by the kinetic energy and/or mutual repulsion between ions confined within the trapping volume.

14. A collision cell comprising as device as claimed in claim 1.

15. An ion trapping or guiding device comprising:

an array of electrodes comprising a first layer of electrodes and a second layer of electrodes, where said first and second layers each comprise a plurality of segmented rod electrodes extending in a third (z) direction, where said first and second layers of electrodes are spaced apart in a first (y) direction and are substantially parallel to each other and to a plane orthogonal to said first (y) direction and extending in a second (x) and the third (z) direction, the plurality of segmented rod electrodes comprising at least three segmented rod electrodes; and one or more voltage sources arranged and adapted to apply one or more voltages to said array of electrodes so as to confine ions substantially within an ion trapping volume which is spatially elongated at least in the second (x) direction.

16. The device of claim 1, wherein said substantially rectangular prism is arranged substantially perpendicular to electrodes of the first layer of electrodes and the second layer of electrodes.

17. The device of claim 1, wherein said substantially rectangular prism is arranged substantially at a center location of the first layer of electrodes and the second layer of electrodes with respect to the third (z) direction.

* * * * *